US005991980A

United States Patent [19]

Meager

[11] Patent Number: 5,991,980

[45] Date of Patent: Nov. 30, 1999

[54] FASTENING DEVICE FOR CREATING A WATERPROOF SEAL BETWEEN FABRICS OR OTHER MATERIALS

[76] Inventor: Ben Meager, 204 Michael Grove, Bozeman, Mont. 59718

[21] Appl. No.: 09/139,815

[22] Filed: Aug. 25, 1998

Related U.S. Application Data

[60] Provisional application No. 60/057,184, Aug. 26, 1997.

[51] Int. Cl.[6] ..... A44B 19/00

[52] U.S. Cl. ..... 24/400; 24/399; 24/587

[58] Field of Search ..... 24/399, 400, 415, 24/417, 427, 429, 433, 587, 434, 436; 283/63, 64; 2/234, 96, 100, 900

[56] References Cited

U.S. PATENT DOCUMENTS

| | | | |
|---|---|---|---|
| 1,706,097 | 3/1929 | Aud . | |
| 1,887,741 | 11/1932 | Trotter . | |
| 1,959,318 | 5/1934 | Sundback | 24/205 |
| 2,217,571 | 10/1940 | Süsskind | 24/436 |
| 2,263,481 | 11/1941 | Austin | 24/434 |
| 2,353,858 | 7/1944 | Tedesco | 24/206 |
| 2,491,524 | 12/1949 | Siple | 24/207 |
| 2,652,611 | 9/1953 | Jaster | 24/201 |
| 2,665,467 | 1/1954 | Bosomworth et al. | 24/201 |
| 2,696,032 | 12/1954 | Sander | 24/201 |
| 2,777,181 | 1/1957 | Morner | 24/201 |
| 2,794,227 | 6/1957 | Dorman | 24/201 |
| 2,869,207 | 1/1959 | Bernstein | 24/201 |
| 2,871,539 | 2/1959 | Swan | 24/201 |
| 2,889,605 | 6/1959 | Morin | 24/436 |
| 2,909,822 | 10/1959 | Botti et al. | 24/201 |
| 2,978,769 | 4/1961 | Harrah | 24/201 |
| 3,259,951 | 7/1966 | Zimmerman | 24/201 |
| 3,309,746 | 3/1967 | Carlile | 24/436 |
| 3,338,285 | 8/1967 | Jaster | 150/3 |
| 3,490,109 | 1/1970 | Heimberger | 24/205.1 |
| 3,579,747 | 5/1971 | Howley | 24/399 |
| 3,591,914 | 7/1971 | Heimberger | 29/408 |
| 3,660,875 | 5/1972 | Gutman | 24/400 X |
| 4,137,608 | 2/1979 | Moertel | 24/436 |
| 4,199,845 | 4/1980 | Ausnit | 24/291 |
| 4,262,395 | 4/1981 | Kosky | 24/400 |
| 4,756,061 | 7/1988 | Jones et al. | 24/433 |
| 4,905,694 | 3/1990 | Will | 606/217 |
| 4,941,238 | 7/1990 | Clark | 24/437 |
| 5,007,142 | 4/1991 | Herrington | 24/400 |
| 5,010,627 | 4/1991 | Herrington et al. | 24/400 |
| 5,062,186 | 11/1991 | Rampolla et al. | 24/399 X |
| 5,283,932 | 2/1994 | Richardson et al. | 24/400 |
| 5,599,415 | 2/1997 | Tomic et al. | 156/159 |
| 5,636,415 | 6/1997 | James | 24/399 |
| 5,809,621 | 9/1998 | McCree et al. | 24/399 |

*Primary Examiner*—James R. Brittain
*Assistant Examiner*—Robert J. Sandy
*Attorney, Agent, or Firm*—Sheridan Ross P.C.

[57] ABSTRACT

Disclosed is a fastening device that is capable of creating a waterproof seal between fabrics and other materials. The fastening device includes two interlocking strips that have a tongue and groove mating relationship. A Z-shaped slider is used to position the interlocking strips such that the tongue portion is mated within the groove portion. The slider is also capable of disassociating the tongue from the groove to separate the fastening device. Stop blocks are provided at the ends of the interlocking strips and can create a fully waterproof seal when the fastening device is closed.

36 Claims, 10 Drawing Sheets

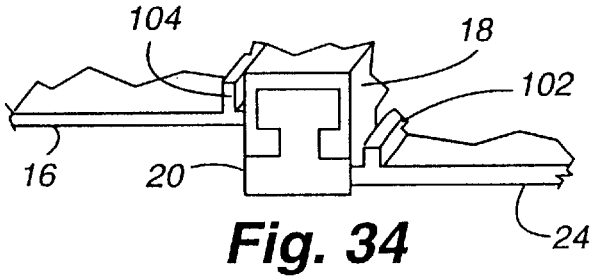
Fig. 34
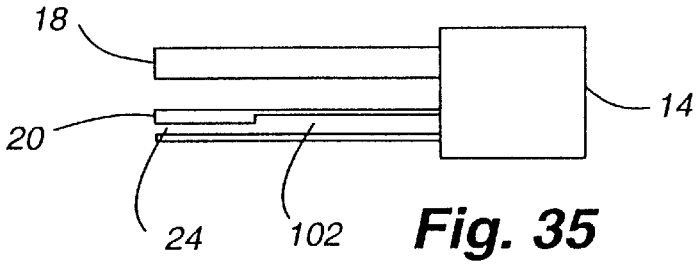
Fig. 35
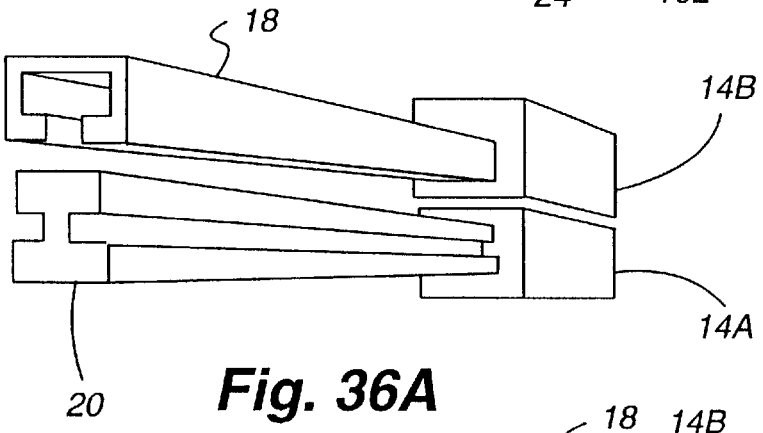
Fig. 36A
Fig. 36B
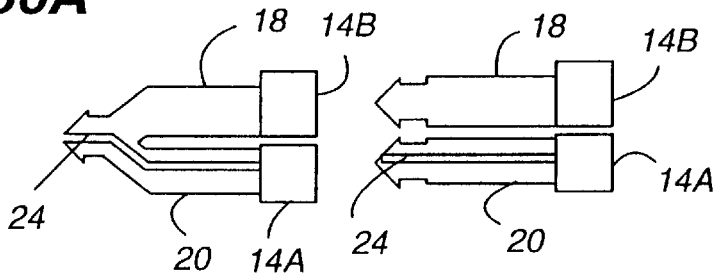
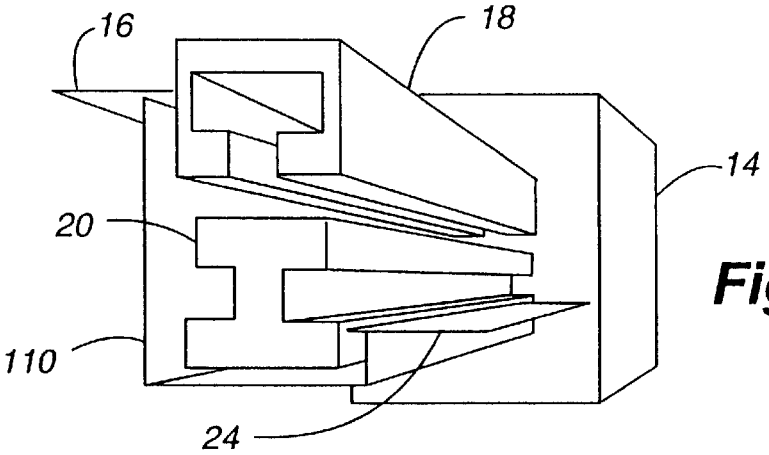
Fig. 37

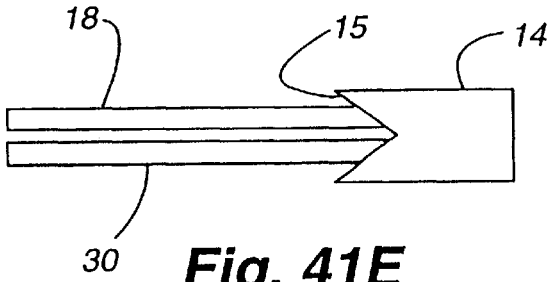
Fig. 41E
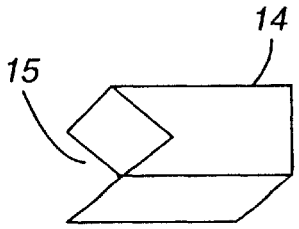
Fig. 41F
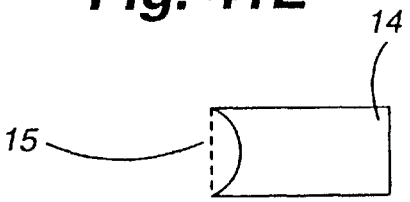
Fig. 42A
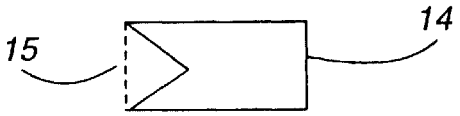
Fig. 42B
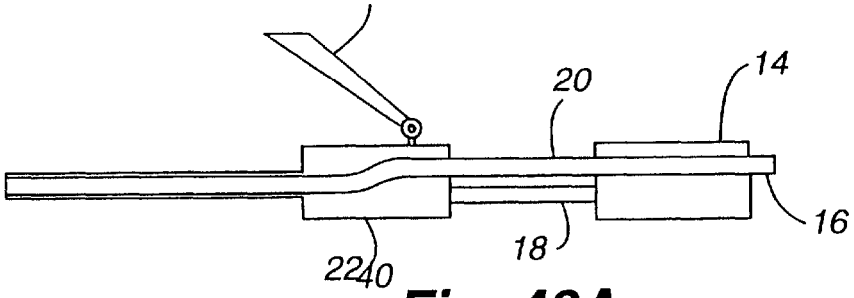
Fig. 43A
Fig. 43B
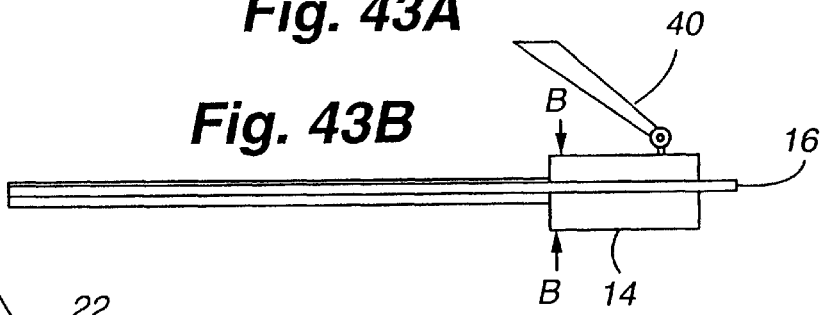
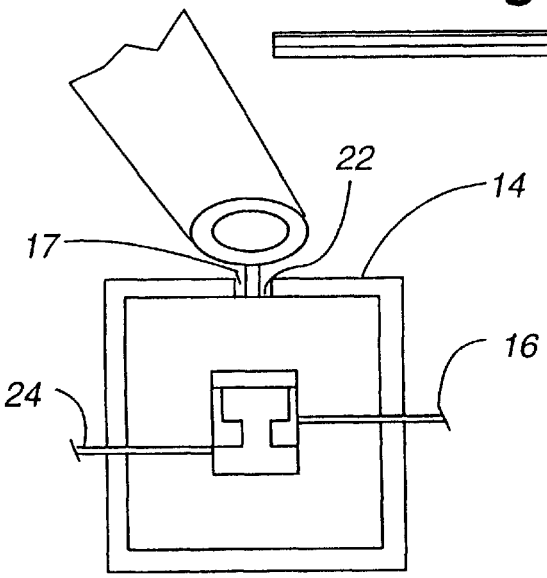
Fig. 44

FASTENING DEVICE FOR CREATING A WATERPROOF SEAL BETWEEN FABRICS OR OTHER MATERIALS

CROSS-REFERENCE TO RELATED APPLICATIONS

The present invention claims priority to U.S. provisional patent application Ser. No. 60/057,184, filed on Aug. 26, 1997, and entitled "A FASTENING DEVICE FOR CREATING A WATERPROOF SEAL BETWEEN FABRICS OR OTHER MATERIALS". Provisional application Ser. No. 60/057,184 is incorporated herein by reference in its entirety.

FIELD OF THE INVENTION

The present invention relates to a fastening device that is capable of creating a waterproof seal between fabrics and other materials.

BACKGROUND OF THE INVENTION

Fastening devices typically include two flexible elongated components having teeth which are forced to interlock and separate by moving a slide along the components. Although such fastening devices have long been used to close and open various articles, such as clothing and bags, such devices suffer from the allowance of liquids and gases within the fastener, and are therefore not useful for conditions in which a windproof and/or waterproof article is desirable.

Fluid-tight fasteners are available, but such fasteners are typically not fluid-tight at the ends of the fastener, are expensive, heavy, and/or require the use of a covering material over the fastener to establish a wind and/or water-tight closure.

SUMMARY OF THE INVENTION

The present invention generally relates to an improved fastening device for creating a waterproof seal between fabrics and other materials.

In one embodiment, the fastening device of the present invention includes a groove strip portion having a first end, a second end and an elongated portion, wherein the elongated portion extends longitudinally from the first end to the second end of the groove strip portion. The elongated portion of the groove strip portion forms a groove profile. The fastener further includes a tongue strip portion having a first end, a second end and an elongated portion, wherein the elongated portion extends longitudinally from the first end to the second end of the tongue strip portion. The elongated portion of the tongue strip portion forms a tongue profile which is capable of cooperatively interlocking with the groove profile. The fastening device also includes a slider which forces the tongue profile to cooperatively interlock with the groove profile as the strip portions pass through the slider. The slider includes: (a) top, bottom and side walls which form a housing having an opening end orifice and a closing end orifice, each of the top, bottom and side walls having an external wall surface and an internal wall surface which forms a channel extending longitudinally through the housing from the opening end orifice to the closing end orifice for passing the groove strip portion and the tongue strip portion therethrough, wherein the internal wall surface comprises upper and lower flange portions integral with the top and bottom walls, respectively, such that the flange portions of the internal wall surfaces extend inwardly along the channel; and (b) a center portion connected to and extending between the side walls and located intermediate between the top wall and the bottom wall at the opening end orifice, the center portion extending longitudinally along less than a total length of the channel, the length being defined from the opening end orifice to the closing end orifice. The center portion creates upper and lower spaces within the channel at the opening end orifice. A height distance of the opening end orifice, which includes the combination of the upper and lower spaces at the opening end orifice, is greater than a height distance of the closing end orifice. The groove strip portion and the tongue strip portion are adapted to pass through the channel from the opening end orifice through the closing end orifice, during which the flange portions force the tongue strip portion and the groove strip portion to come into contact, thereby forcing the tongue profile to cooperatively interlock with the groove profile as the strip portions pass through the slider. The slider can further comprise a handle for moving the slider longitudinally along the tongue and groove strip portions, thereby allowing the tongue and groove portions to move through the channel of the slider.

Also included in the invention are various embodiments related to the tongue profile and the groove profile. In one embodiment, the tongue profile includes a narrow connector piece integral with an enlarged head, and the groove profile includes a flexible narrow opening integral with a cavity portion. The cavity portion is shaped complimentary to the enlarged head portion and the narrow opening is shaped complimentary to the narrow connector piece such that the cavity portion receives the enlarged head portion and the narrow opening receives the narrow connector piece when the tongue strip portion and the groove strip portion are cooperatively interlocked. Various other aspects of this embodiment are disclosed. In another embodiment, the tongue and groove strip portions cooperatively interlock with one another by frictional engagement.

In another embodiment of the present invention, the device further includes a first stop block fixedly connected to the first end of the groove strip portion and the first end of the tongue strip portion, and a second stop block fixedly connected to the second end of the groove strip portion and the second end of the tongue strip portion. At least one of the first and second stop blocks can have a shape profile and the slider can have a complementary face adapted for cooperatively engaging and interlocking with the shape profile when the slider is at the stop block.

In one embodiment, at least one of the first and second stop blocks is removably attachable to the groove strip portion and the tongue strip portion.

In another embodiment, the slider can include a first mating portion disposed within the channel for mating with the groove profile; and a second mating portion disposed within the channel for mating with the tongue profile, wherein the first and second mating portions position the tongue and groove profiles to be cooperatively interlocked. The first and second mating portions can, in one embodiment, be disposed at an angle relative to one another such that the tongue and groove strip portions mating with the first and second mating portions, respectively, are disposed at an angle relative to one another.

In yet another embodiment, the stop block is fixedly secured to the groove strip portion at at least one of the first and second ends, and at least one of the first and second ends of the tongue strip portion are removably attached within the first stop block. Such a stop block can further include a force generating device which releasable compresses the ends of the tongue and groove strip portions within the first stop block to secure the tongue and groove strip portions together. In one embodiment, such a force generating device can include: a button disposed externally to the stop block; a spring biasing the button and disposed within the stop block; and, an internal holder disposed within the stop block for contacting the ends of the tongue strip portion, the internal holder being connected to and compressible by the spring. Depression of the button compresses the spring and causes the internal holder to apply a force to the tongue strip portion, thereby securing the tongue strip portion within the stop block. In a further embodiment, the end of the tongue strip portion further includes a notch, and the force generating device further includes a tab located within the internal holder and positioned such that the tab engages the notch when the tongue strip portion is within the end stop and when the force generating device is compressed to secure the tongue strip portion within the stop block.

Yet another embodiment of the present invention includes a first stop block for connecting the first ends of the groove strip portion and the tongue strip portion, wherein the first stop block is separable into two portions to allow the first ends of the groove strip portion and the tongue strip portion to be individually separated at the first stop block. In this embodiment, the fastener additionally includes a second stop block for connecting the second ends of the groove strip portion and the tongue strip portion, wherein the second stop block is separable into two portions to allow the second ends to be individually separated at the second stop block.

In yet another embodiment, the stop block for securing at least one of the first and second ends of the groove strip portion and at least one of the first and second ends of the tongue strip portion includes: a first enlarged portion having first and second ends, the first end of the first enlarged portion being fixed within the stop block, and the second end of the first enlarged portion being connected to the groove strip portion and having a first interface portion; and a second enlarged portion having first and second ends, the first end of the second enlarged portion being fixed within the stop block, and the second end of the second enlarged portion being connected to the tongue strip portion and having a second interface portion. The first and second interface portions are disposed to become engaged to form an interface when the groove strip portion and the tongue strip portions are interlocked at the stop block. Additionally, the first and second enlarged portions are larger than the groove and tongue strip portions and are adapted to be received within the channel of the slider to fixedly secure the slider over the first and second enlarged portions. In a further embodiment, the second end of the first enlarged portion is an integral part of the groove strip portion, and the second end of the second enlarged portion is an integral part of the tongue strip portion.

In yet another embodiment, the stop block is fixedly connected to at least one of the first and second ends of the groove strip portion and the tongue strip portion. The stop block includes a bar fixedly connected to and extending from the stop block, the bar being located on the stop block between the at least one of the first and second ends of the tongue and groove strip portions. The bar compresses the tongue and groove strip portions against the internal wall surface of the slider when the slider is positioned at the stop block to securely engage the slider at the stop block. In a further embodiment, a thickness of the bar is adjustable by a user to allow the slider to be positioned at the stop block and securely engaged. In yet another embodiment, the center portion of the slider can include a longitudinal opening for receiving the bar when the slider is at the stop block. The stop block can also include a force generating device having a positionable button disposed in relationship to the bar to apply a compressive force on the bar when the button is depressed such that the slider is freely moveable at the stop block. The release of the button allows the bar to compress the tongue and groove strip portions against the internal wall surface of the slider when the slider is positioned at the stop block to securely engage the slider at the stop block.

In another embodiment of the present invention, the device also includes a first material portion connected longitudinally along an outward facing edge of the groove strip portion, and a second material portion connected longitudinally along an outward forcing edge of the tongue strip portion. The first and second material portions are further connected to an article containing the fastener. The slider is adapted with a first slot located longitudinally in one side wall and a second slot located longitudinally in another side wall to allow the first and second material portions to pass therethrough as the slider is moved along the tongue strip portion and the groove strip portion. In this embodiment, the first material portion and the second material portion can be located on the outward facing edges of the groove strip portion and the tongue strip portion, respectively, in a non-opposing configuration. In a further embodiment, the first material portion can include a first ridge portion extending perpendicularly from the first material portion, connected to the first material portion, and located a distance from the stop block, and the second material portion can include a second ridge portion extending perpendicularly from the second material portion, connected to the second material portion, and located a distance from the stop block. The slider has first and second mating groove portions adapted to receive the first and second ridge portions, each of the first and second mating groove portions being located within one of the side walls of the slider and extending perpendicularly to the first and second slot, respectively. The first and second mating groove portions correspondingly engage the first and second ridges when the slider is positioned at the stop block.

In yet another embodiment, a cover portion is interconnected with the first and second material portions and located at the stop block, the cover portion extending perpendicularly from the first material portion, extending over the external wall surface of the bottom wall of the slider, and connecting perpendicularly to the second material portion to encase at least a portion of the slider when the slider is positioned at the end stop. In one embodiment, the cover portion extends longitudinally from over the stop block to beyond the slider when the slider is positioned at the stop block.

In yet another embodiment, the second stop block has an interior space configured to receive the slider when the slider is at the stop block. In this embodiment, the stop block can further include a handle groove for receiving the handle when the slider is positioned at the stop block. The handle can also have a ridge for securely engaging the handle groove. In yet a further embodiment, the stop block can have a cover which is moveable to enclose the stop block when the slider is within the stop block.

BRIEF DESCRIPTION OF THE DRAWINGS OF THE INVENTION

FIG. 34 is a cross-sectional view illustrating ridges extending from material portions attached to an end stop block;

FIG. 35 is a side view showing an end stop block containing ridges extending from the end stop block;

FIG. 36A is a perspective view showing end stop blocks separated into two separate pieces;

FIG. 36B is a side view illustrating an end stop block separated into two portions;

FIG. 37 is a perspective view illustrating an end stop block having a cover portion;

FIG. 41E is a side view showing an end stop block having a shape profile;

FIG. 41F is a perspective view of a slider having a complementary face to the shape profile of the end stop block of FIG. 41E;

FIG. 42A is a side view of an end stop block having a bowl-like shape profile;

FIG. 42B is a side view of an end stop block having a pyramid shape profile;

FIG. 43A is a side view of a fastener having an end stop block configured to have an interior space for housing a slider;

FIG. 43B is a side view of a fastener having a slider positioned within an end stop block having an interior space;

FIG. 44 is a cross-sectional view of a slider securely positioned within an end stop block;

DETAILED DESCRIPTION OF THE INVENTION

The present invention provides a fastening device for creating a waterproof seal between materials, including, but not limited to, fabrics, tapes, polymeric materials and metal-containing materials. The fastening device includes two interlocking strips having a tongue and groove relationship. A slider is provided which is used to position the strips to allow for interlocking of the tongue within the groove or for disassociating the tongue from the groove. Stop blocks are provided at the first and second longitudinal ends of the interlocking strips. The stop blocks may be created in several embodiments to account for the uses of the fastener. In particular, the fastening device of the present invention provides several means of creating a substantially water-resistant and/or wind-resistant or wind-proof and/or water-proof seal.

The present invention provides several advantages over the prior art. The fastener is windproof and waterproof and, as such, eliminates the need for coverings over the zipper portion of articles. In addition, the fastener may be formed from non-metallic materials, therefore making the fastener lightweight and inexpensive. As such, these materials provide a fastening system that has less tendency to jam or to create unwanted noise. Further, the present invention has many applications. The fastening device is capable of being used with any article of clothing, especially those used in activities that encounter wind and water, such as mountaineering or boating. In addition, the present invention may be used to fasten bags and luggage-type articles that are used to transport items.

Figure 1A:
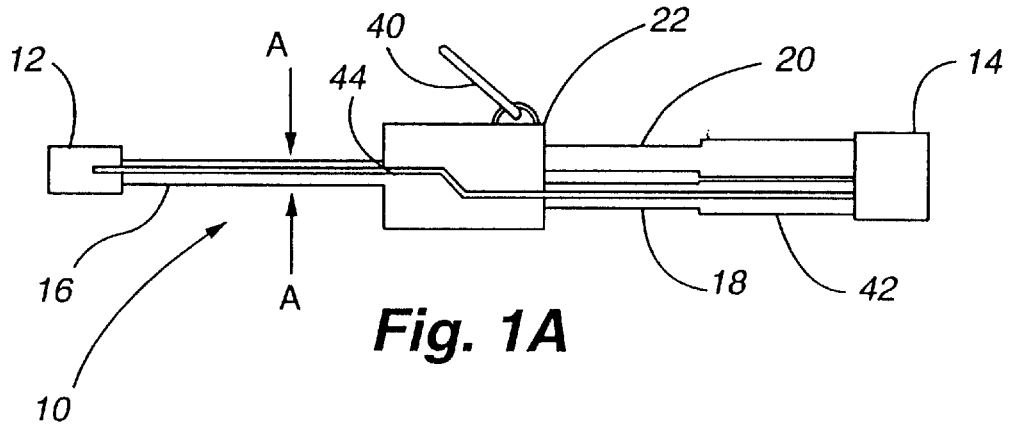
FIG. 1A is a side view of a fastening device of the present invention.
Figure 1B:
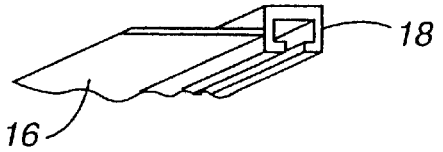
FIG. 1B is a perspective view of groove strip portion connected to material portion.
Figure 1C:
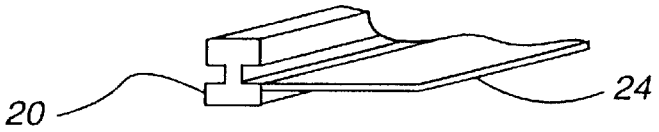
FIG. 1C is a perspective view of a tongue strip portion connected to a material portion.

Referring to FIGS. 1A–C, one embodiment of the present invention is shown in which a fastening device 10 includes a groove strip portion 18 and a tongue strip portion that have a material portion, including, but not limited to a tape or waterproof fabric 16 and 24, attached to an outward facing side edge of the strip portions 18 and 20. The groove strip portion has a first end, a second end and an elongated portion, the elongated portion extending longitudinally from the first end to the second end of the groove strip portion. A groove profile is located longitudinally along the elongated portion of the groove strip portion The tongue strip portion has a first end, a second end and an elongated portion, the elongated portion extending longitudinally from the first end to the second end of the tongue strip portion. A tongue profile is located longitudinally along the elongated portion of the tongue strip portion. The tongue profile cooperatively interlocks with said groove profile to close the fastening device of the present invention. The tongue and groove strip portions can be formed from any suitable material, including, but not limited to metal-containing materials and polymeric materials. In a preferred embodiment, the tongue and groove strip portions are formed of a polymeric material.

The material portions, such as tape or waterproof fabric portions 16 and 24, are capable of being attached to the article requiring the fastening device 10. According to the present invention, the material portions can be any material portions which are to be brought together by a fastener of the present invention. Such material portions can include, but are not limited to fabrics, tape, any polymeric material, rubber, and metal-containing materials, for example.

In this embodiment, a slider 22 having a handle 40 is moveable along the tongue and groove strip portions and cooperatively interlocks or separates the tongue and groove strip portions 18 and 20, depending upon the direction in which the slider 22 is moved. On each side wall of the slider 22, a slot opening 44 longitudinally traverses the side wall to allow the tape or fabric portions 16 and 24 to travel through the slider 22 as the slider 22 moves longitudinally along the tongue and groove strip portions such that the fastening device 10 may close the article when the tongue and groove strip portions 18 and 20 are interlocked. As used herein, the term "longitudinal" and its derivatives, refers to the axis of the elongated portion of the fastener, which includes the elongated portion of the tongue and groove strip portions. First and second stop blocks 12 and 14 (i.e., a beginning stop block 12 and an end stop block 14) are provided at each end of the tongue and groove strip portions 18 and 20. In one embodiment, the second end block 14 has an enlarged terminating portion 42. In one aspect, the enlarged terminating portion 42 comprises the strip portions 18 and 20 that have an increased thickness to allow the slider 22 to securely fit around the enlarged terminating portion 42.

Figure 2:
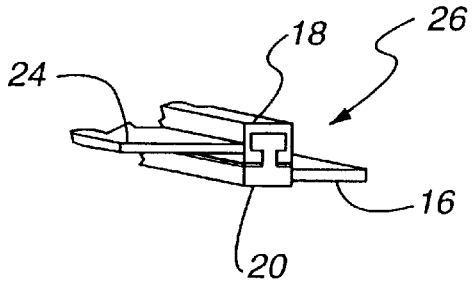
FIG. 2 is a perspective view of a tongue strip portion interlocked with a groove strip portion having material portions connected in an opposing configuration.

The cross-section A—A of FIG. 1, as shown in FIG. 2, illustrates the tongue strip portion 20 interlocked with the groove strip portion 18. In FIG. 2, the tape or fabric portions 16 and 24 are connected to the outward facing sides of the tongue and groove portions 18 and 20. The tape and fabric portions, shown in FIG. 2, are connected in an opposing configuration. According to the present invention, an opposing configuration can be referred to as a z-configuration. This configuration is desired for fasteners 10 that are used with jackets, sleeping bags, duffel bags, etc.

Figure 3:
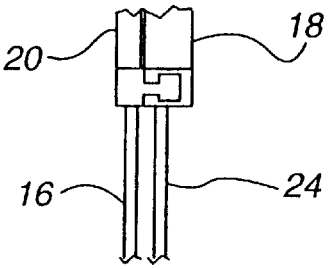
FIG. 3 is a perspective view of a tongue strip portion interlocked with a groove strip portion showing material portions connected in a non-opposing configuration.

In FIG. 3, the tape or fabric portions 16 and 24 are connected in a non-opposing configuration. This configuration is desired with fasteners 10 that are used in bags or other articles that do not require the fastener to have a flat profile. In one embodiment, the tape or fabric portions 16 and 24 may have a thickness of at least ½ cm. The thickness of the tongue and groove portions 18 and 20 will vary according to the use requirements of the fastener 10. For example, those articles that require a waterproof seal may have a thicker profile than others that do not require such a fastener.

Figure 4:
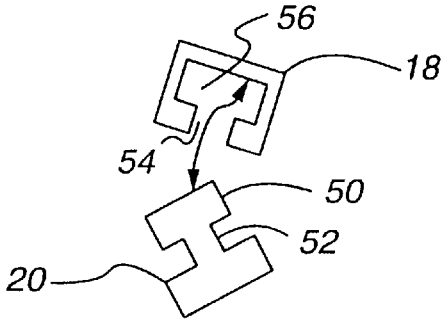
FIG. 4 is a cross-sectional view of a tongue strip portion being interlocked with a groove strip portion.

In FIG. 4, the tongue strip portion 20 is shown being interlocked with the groove strip portion 18. In one embodiment, the tongue strip portion 20 has a tongue profile comprising an enlarged head 50 and a narrow connector piece 52. The groove portion has a groove profile comprising a narrow opening 54 that leads to a locking cavity portion 56. For the enlarged head 50 to fit through the narrow opening 54, the groove strip portion 18 must be capable of flexing. This flexing characteristic of the groove strip portion 18 may be enhanced if the portion 18 is constructed of a polymeric material.

Figure 6:
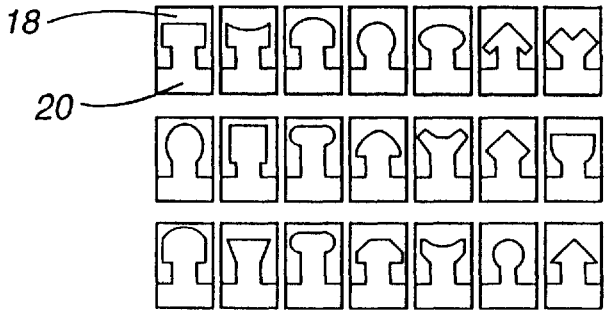
FIG. 6 is a cross-sectional view showing several embodiments of tongue and groove strip portions.

Typically, the locking cavity portion 56 is sized to securely fit the enlarged head portion 50. In FIG. 6, several embodiments of tongue and groove strip portions 18 and 20 are illustrated. In this embodiment, the enlarged head portion 50 and the locking cavity portion are correspondingly shaped to ensure a secure interlocking mechanism.

Figure 7A:
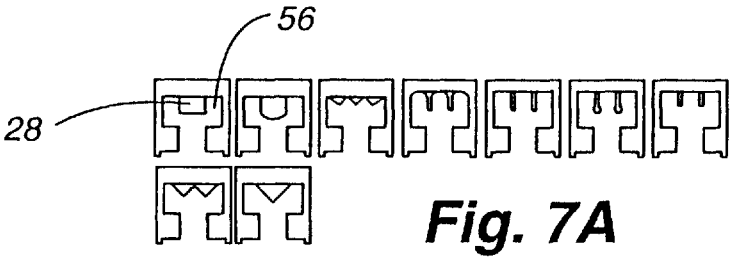
FIG. 7A is a cross-sectional view of groove mating portions within the locking cavity portion of the groove strip portion.
Figure 7B:
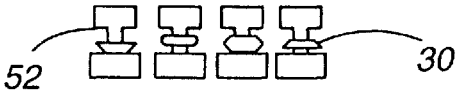
FIG. 7B is a cross-sectional view of tongue mating portions positioned on the connector piece of the tongue groove portion.
Figure 7C:
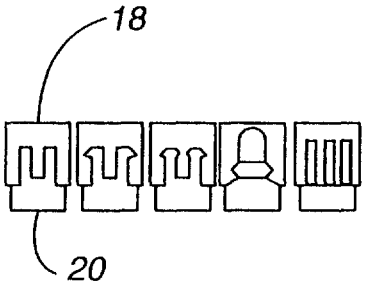
FIG. 7C is a cross-sectional view showing various embodiments of interlocked tongue and groove strip portions.

In another embodiment, as shown in FIG. 7A and 7B, groove shape-inserts 28 are positioned within the locking cavity portion 56 (FIG. 7A). Similarly, tongue shape-inserts 30 are positioned on the narrow connector piece 52 (FIG. 7B). These shape-inserts 28 and 30 are provided to increase the strength and water resistance of the tongue and groove connector system. Typically, the shape-inserts 28 and 30 can be composed of different higher strength materials, such as less flexible plastics or rubber. In addition, as shown in, but not limited to, FIG. 7, the tongue and groove portions 18 and 20 may comprise an assortment of shapes. The tongue portion 20 may have several tongue pieces for interlocking with the groove portions. These embodiments may allow for secure fastening and increased water resistance.

Figure 8A:
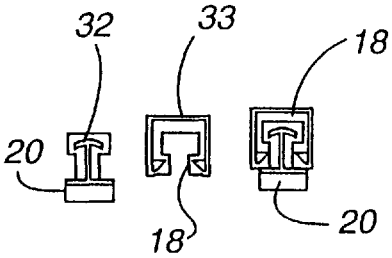
FIG. 8A is a cross-sectional view illustrating metallic mating portions within tongue and groove strip portions.
Figure 8B:
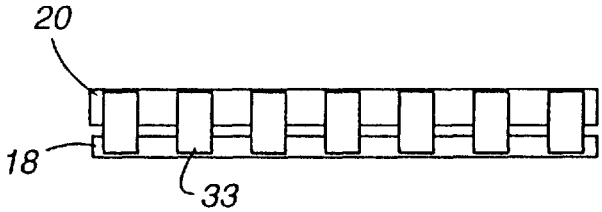
FIG. 8B is a plan view showing metallic mating portions spaced along the length of a fastener of the present invention.

In another embodiment as shown in FIG. 8A, metallic inserts 32 and 33 can be placed within the tongue and groove portions 20 and 18. The metallic insert 32 is positioned within the tongue strip portion 20. The metallic insert 33 is positioned within the groove strip portion 18. These metallic inserts 32 and 33 are provided to create a fastener having increased durability and strength. Rather than being a continuous piece, the metallic inserts 32 and 33 are spaced equidistantly along the length of the fastener as illustrated in FIG. 8B. This spacing allows the fastener to be flexible. Although one type of insert is shown in FIG. 8A, it should be appreciated that the metallic inserts can vary in shape and size according to the configuration of the tongue and groove.

Figure 47:
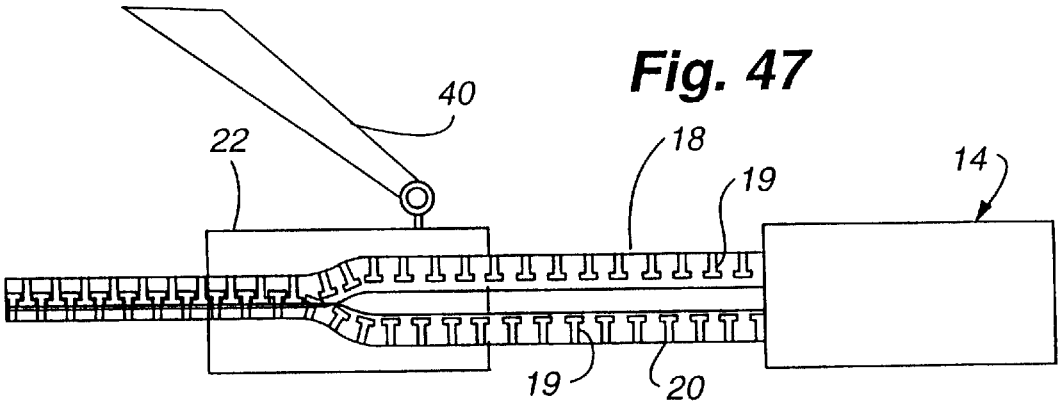
FIG. 47 is a side cross-sectional view showing tongue and groove strip portions having teeth.

In another aspect of the tongue and groove strip portions 18 and 20, as shown in FIG. 47, teeth 19 may be located in the tongue and groove portions 18 and 20. The teeth 19 are capable of being interlocked when the tongue strip portion 20 and the groove strip portion 18 are connected. It should be appreciated that the teeth 19 in the tongue strip portion 20 are not necessarily housed within the tongue strip portion 20. The teeth 19 may be connected directly to the tongue strip portion 20 without having a housing located around the teeth 19.

In FIG. 5 and 9–12, a slider 22 is shown that facilitates locking of the tongue portion 20 within the groove portion 18. In one embodiment of the present invention, a slider 22 according to the present invention has top, bottom and side walls which form a housing having an opening end orifice 23 and a closing end orifice 25. Each of the top, bottom and si d e walls therefore have an external wall surface and an internal wall surface which forms a channel (not shown) extending longitudinally through the housing from the opening end orifice 23 to the closing end orifice 25 for passing the groove strip portion 18 and said tongue strip portion 20 therethrough. Additionally a slider 22 has upper and lower flange portions which are integral with the top and bottom walls, respectively, and which extend inwardly from the internal wall surfaces along said channel. Finally, a slider 22 also includes a center portion 34 connected to and extending between the side walls and located intermediate the top wall and the bottom wall at the opening end orifice 23. As used herein, the term "intermediate" means at any point between the top wall and the bottom wall, which includes, but is not to be limited to, a location central (i.e., equidistant) between the walls. The center portion 34 extends longitudinally along less than a total length of the channel 21, the length of the channel being defined as from the opening end orifice 23 to the closing end orifice 25, thus creating upper and lower spaces 38 and 36 within the channel 21 at the opening end orifice 23. Therefore, the groove strip portion 18 and the tongue strip portion 20 are adapted to pass through the channel 21 from the opening end orifice 23 through the closing end orifice 25, during which time the flange portions force the tongue strip portion 20 and the groove strip portion 18 to come into contact. In this manner, the tongue profile becomes cooperatively interlocked (e.g., engaged) with the groove profile as the strip portions pass through the slider 22. These embodiments are described in detail below.

Figure 5:
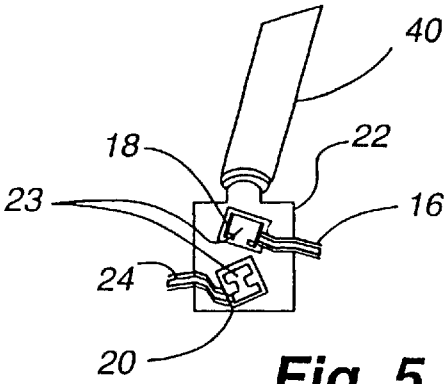
FIG. 5 is a cross-sectional view of a tongue strip portion being interlocked with a groove strip portion within a slider.

In this embodiment of the slider 22 shown in FIG. 5, the tongue and groove strip portion 18 and 20 are disposed at an angle to one another. This configuration allows the enlarged head portion 50 to more easily fit within the narrow opening 54 because the enlarged head portion 50 enters the narrow opening 54 at an acute angle rather than being inserted perpendicularly.

In another embodiment of the present invention, the tongue strip portion 20 and the groove strip portion 18 are cooperatively interlocked by frictional engagement of a groove profile with a tongue profile, rather that by the locking engagement of the enlarged head portion 50 and cavity portion 56 embodiment described above.

Figure 9:
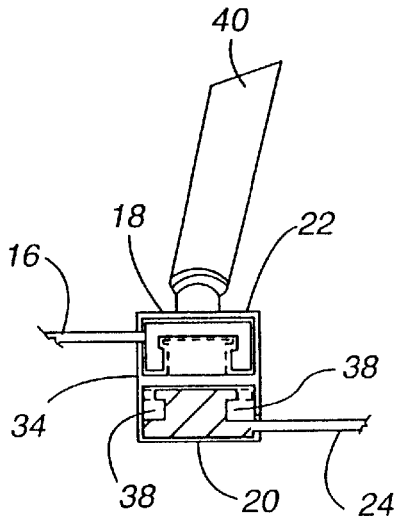
FIG. 9 is a cross-sectional view of an opening and orifice of a slider of the present invention.
Figure 24:
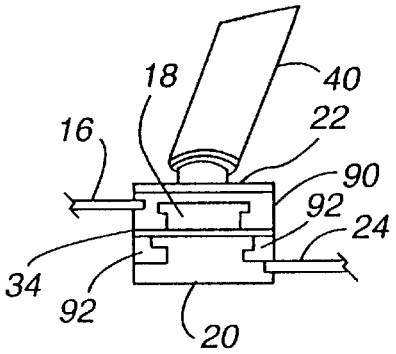
FIG. 24 is a cross-sectional view illustrating a modified slider containing inserts that directly mate with tongue and groove strip portions.
Figure 25:
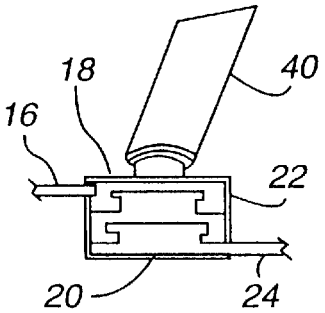
FIG. 25 is a cross-sectional view of tongue and groove strip portions within a modified slider containing mating portions.
Figure 26:
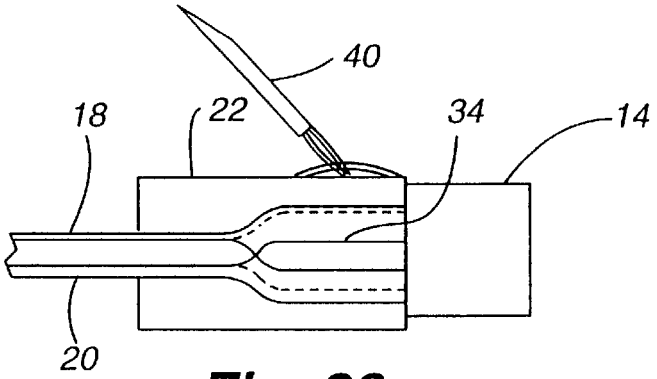
FIG. 26 is a side cross-sectional view of a slider positioned at an end stop block having a gap area filled with a center portion of the slider.
Figure 27:
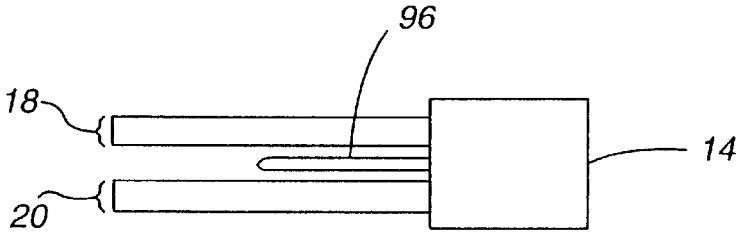
FIG. 27 is a side view of an end stop block connected to tongue and groove portions illustrating a bar positioned between the tongue and groove portions.
Figure 28:
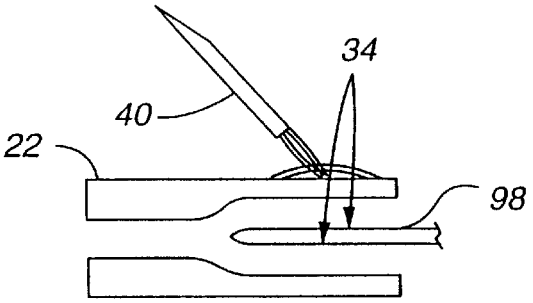
FIG. 28 is a side cross-sectional view of a slider having a center portion containing an opening adapted to receive a bar of an end stop block.
Figure 29:
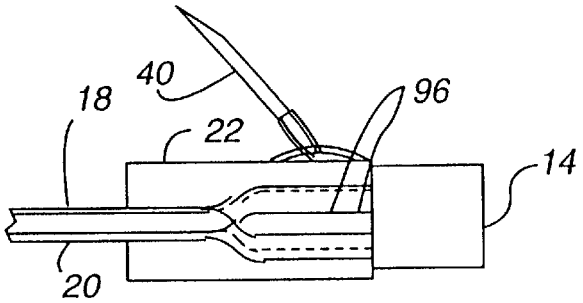
FIG. 29 is a side cross-sectional view of a slider positioned at an end stop block having a bar positioned between the tongue and groove portions.

In FIG. 9, an opening end of the slider 22 is shown where the tongue strip portion 20 and the groove strip portion 18 fit within a first compartment (i.e., a first or upper inner space) 38 and a second compartment (i.e., a second or lower inner space) 36. A divider, or center portion, 34 is used to separate the first compartment (or space) 38 from the second compartment (or space) 36. In one embodiment as shown in FIGS. 24 and 25, the first and second compartments 38 and 36 may be designed with a complementary fitted insert (i.e. a mating portion) 90 and 92 to match (i.e. mate with) the tongue and groove profiles of the tongue and groove strip portion 18 and 20. This complementary fitted insert (i.e. mating portion) provides for secure engagement and water resistance of the tongue and groove strip portions 18 and 20 within the opening end of the slider 22.

In another embodiment, the first and second compartments (inner spaces) 36 and 38 and/or the mating portions (complementary fitted inserts) 90 and 92 may be formed such that the tongue and groove strip portions 18 and 20 pass through the slider 22 at an angle with respect to each other to facilitate interlocking of the tongue strip portion 20 within the groove strip portion 18.

As illustrated in FIG. 9, the tape or fabric portions 16 and 24 can extend through the slider 22 along the outward facing sides. These openings create a slider 22 with essentially a Z cross-section. A handle (tab) 40 is also provided such that the slider 22 may be easily manipulated by an operator's fingers.

Figure 10:
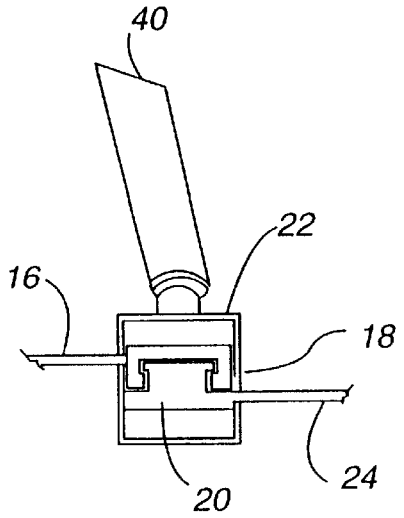
FIG. 10 is a cross-sectional view of a closing end orifice of the slider of the present invention.
Figure 11:
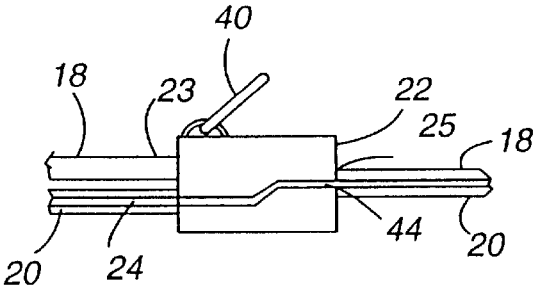
FIG. 11 is a side view of the fastener illustrating the tongue and groove strip portions inserted through the slider.

In FIG. 10, the closing end of the slider 22 is shown, in which the tongue and groove strip portion are interconnected as the fastener exits the slider 22. In comparing FIG. 9 to FIG. 10, the vertical height (i.e., height distance) of the opening end orifice 23 (equal to the height distance of the combination of the upper and lower spaces 36 and 38) is larger than the vertical height (i.e., height distance) of the closing end orifice 25 (closing end space). This vertical height relationship is required for interlocking the tongue strip portion 20 within the groove strip portion 18. As shown in FIG. 11, the side view of the slider 22 has the groove portion 18 and the tongue portion being inserted into the opening end 23 of the slider 22. The tape or fabric portion 24 passes through the side opening 44. As the tongue and groove strip portions 18 and 20 exit the slider 22 at the closing end 25, the portions 18 and 20 are cooperatively interlocked.

Figure 12:
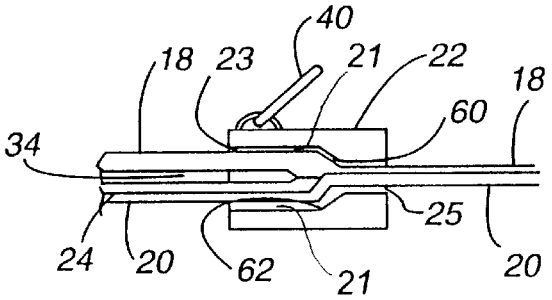
FIG. 12 is a cut-away view of the slider illustrating a center portion extending along less than the total length of the slider.

In FIG. 12, a cutaway portion of the slider 22 has the center portion (e.g. divider), which is located centrally at the opening end orifice 23 and is connected to the walls of the slider 22, 34 extending along less than the total length of the slider 22 such that the center portion creates upper and lower spaces 38 and 36 at the opening end orifice 23, but not at the closing end orifice 25. After the tongue and groove strip portions 18 and 20 are inserted into the first and second compartments 38 and 36 of the opening end 23 of the slider 22, the strip portions 18 and 20 travel within the slider 22 as the slider 22 is moved by pulling on the handle (tab) 40. As the divider (central portion) 34 terminates within the slider 22, the strip portions 18 and 20 encounter inward sloping (i.e., inwardly extending) flange portions 60 and 62 that are integral with the walls of the slider 22, which direct the strip portions 18 and 20 together. The flange portions 60 and 62 therefore effectively narrow the channel 21 through the slider 22 proceeding longitudinally from the opening end orifice 23 to the closing end orifice 25. Therefore, as the strip portions 18 and 20 exit from the closing end 25 of the slider 22 the tongue strip portion 20 is cooperatively interlocked with the groove strip portion 18.

Figure 13:
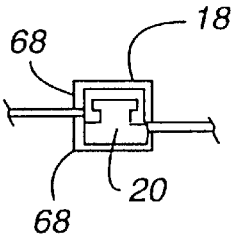
FIG. 13 is a cross-sectional view of a stop block having tongue and groove strip portions permanently fixed within a housing.

In FIG. 1, the fastener 10 includes a beginning stop block 12 and an end stop block 14. In the embodiment shown in FIG. 1, the beginning stop block 12 is a fixed stop block. Referring to FIG. 13, a fixed stop block has the tongue and groove strip portions 18 and 20 permanently fixed within a housing 68. As shown in FIG. 36, the end stop blocks may be split into two separate pieces, 14A and 14B. In the embodiment shown in FIG. 36, the groove strip portion 18 is connected to end stop block 14B and the tongue strip portion 20 is connected to end stop block 14A. The individual separable end stop blocks 14A and 14B are particularly useful in articles that require the fastener 10 to be separated (i.e., jackets).

In another aspect of the invention, as shown in FIGS. 41A–F, the second end portion 14 may contain a shape profile 15 which is used to engage the slider 22. A complementary face is also provided on the slider 22 such that when the slider 22 is engaged at the second end portion 14, the shape profile 15 mates with the slider 22 to provide a more secure and waterproof connection. In FIGS. 41A–F, various configurations of the shape profile 15 are shown, and it should be appreciated that the configurations are not limited to those shown. As such, any configuration that provides a complementary mating profile with the slider 22 is encompassed by this disclosure. In this regard, in FIGS. 42A and 42B, other aspects of the present invention are shown where the second end portion 14 has a three-dimensional shape profile 15. In FIG. 42A, the shape profile 15 has a bowl-like shape, and in FIG. 42B, the shape profile 15 has a pyramid-like shape. These shape profiles are configured to mate with a complementary profile on the slider 22.

Figure 14:
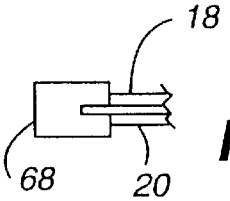
FIG. 14 is a side view of a stop block showing tongue and groove strip portions permanently fixed within a housing.

In FIG. 14, a side view of a fixed stop block shows that the tongue and groove portions are permanently fixed (i.e., fixedly connected) within the housing 68. The fixed stop block can be used with duffel bags, bivy sacks and other containers where the tongue and groove strip portions 18 and 20 are not required to be separated at one end.

Figure 15:
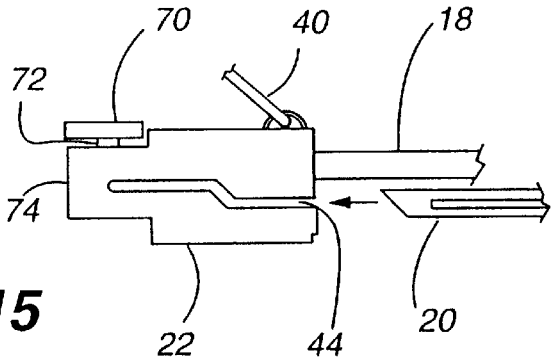
FIG. 15 is a side view illustrating a stop block having a force generating device for securing an end of a tongue strip portions.

For articles that require the tongue and groove strip portions 18 and 20 to be separated, such as in jackets and sleeping bags, a force generating device can be used in an end stop block to compress the tongue and groove portions, therefore securing the portions together and providing a stop block that is removably attachable to at least one of the stip portions. For example, a spring loaded end stop 74 is shown in FIG. 15. The spring loaded end stop 74 has the groove strip portion 18 fixedly secured within the end stop 74. The tongue strip portion 20 can be fed through the slider 22 and into the end stop 74. Alternatively, it should be appreciated that the tongue strip portion 20 may be fixedly secured within the end stop 74 and the groove strip portion 18 can be fed through the slider 22.

Figure 16:
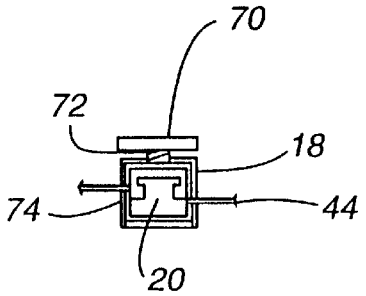
FIG. 16 is a cross-sectional view of illustrating a stop block having a force generating device for securing an end of a tongue strip portions.
Figure 17:
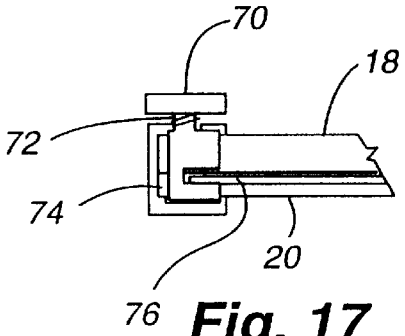
FIG. 17 is a side cross-sectional view of a stop block having a force generating device within an internal holder.

Referring to FIGS. 15–17, a spring 72 biases a button 70 that moves an internal holder 76. When a force is placed on button 70, the internal holder 76 opens to allow the tongue portion to fit within the end stop 74. When the force is released, the internal holder 76 securely fastens the tongue and groove strip portions 18 and 20 within the end stop 74. The tongue and groove strip portions 18 and 20 are securely fixed within the end stop 74 due to the upward force supplied by the spring 72 on the internal holder 76. This upward force compresses the tongue and groove portions 18 and 20, therefore, securing the portions 18 and 20 within the end stop 74.

Figure 19:
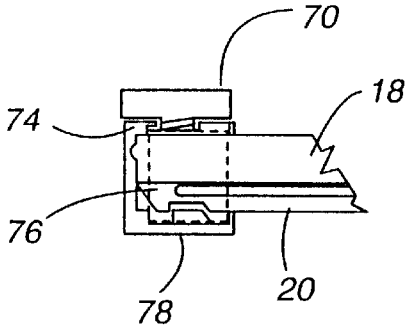
FIG. 19 is a side cross-sectional view illustrating the positioning of a tongue strip portion within an end stop having a force generating device.
Figure 18:
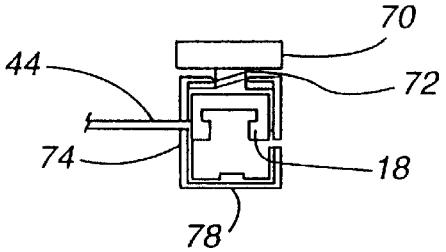
FIG. 18 is a cross-sectional view of a stop block having a force generating device having a tab within the internal holder.

In another embodiment of the end stop 74, as shown in FIGS. 18 and 19, a tab 78 can be located within the internal holder 76. As shown in FIG. 19, the tab 78 is positioned such that when the tongue strip portion 20 is inserted within the end stop 74, a notch portion (not shown) on the bottom surface of the tongue strip portion 20 connects with the tab 78. When pressure is released from button 70, the tab 78 securely fastens the tongue strip portion 20 within the end stop 74.

From the FIGS. 13–19, it should again be appreciated that the end stop 74 and housing 68 can contain a side cut portion 44 to allow the tape or fabric portions 16 and 24 to enter the end stop 74 and housing 68.

Referring to FIG. 1, the end stop block 14 can be fixed or separable. For articles that require the tongue and groove strip portions 18 and 20 to be separate, such as a jacket, the end stop block 14 is split to allow separation of the tongue strip portion 20 from the groove strip portion 18. As shown in FIG. 1, the tongue and groove strip portions may be enlarged at the first or second end of the strip portion (second end illustrated) to form an enlarged terminating portion 42 having a first and second end, such that the slider 22 can be tightly secured around the enlarged terminating portion 42. This embodiment is discussed in detail below.

Figure 20:
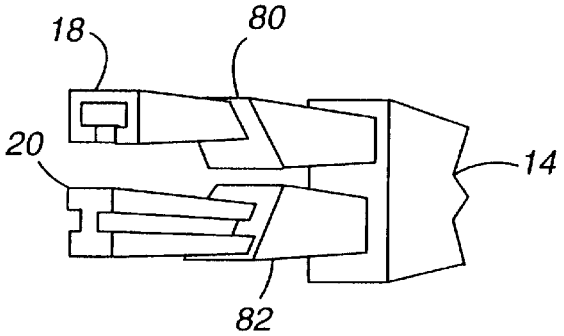
FIG. 20 is a perspective view of tongue and groove strip portions connected to enlarged portions.

For articles where the end stop, block 14 does not require separation, a fully waterproof seal can be created. In one embodiment, as shown in FIGS. 20–23, enlarged portions 80 and 82 are connected to the groove and tongue strip portions 18 and 20, respectively. As shown in FIG. 20, the enlarged portions 80 and 82 are solid and do not contain a tongue or groove profile pattern.

Figure 21:
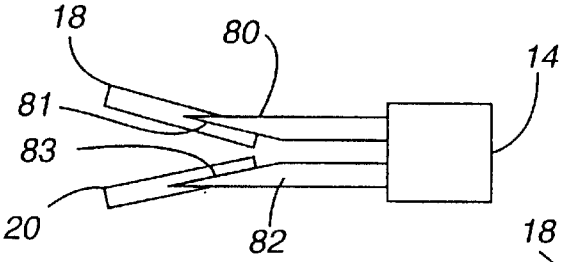
FIG. 21 is a side view illustrating complementary faces of the enlarged portions in an open fastener.
Figure 22:
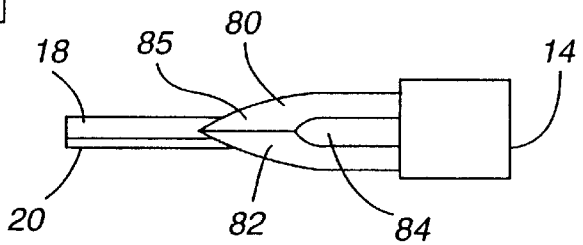
FIG. 22 is a side view illustrating complementary faces of enlarged portions engaged along an interface in a closed fastener.
Figure 23:
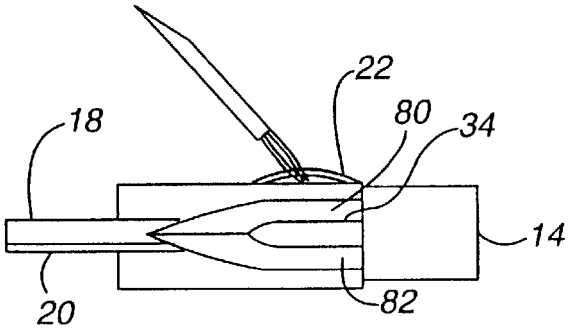
FIG. 23 is a side cross-sectional view showing a slider secured at an end stop block with a center portion filling a gap of the end stop block.

The first ends of enlarged portions 80 and 82 are permanently affixed within the end stop block 14. The second ends of the enlarged portions 80 and 82 have complementary faces, also referred to herein as interface portions, 81 and 83 that are cut at an angle as shown in FIG. 21. In one embodiment, the angle is about twenty degrees. As the tongue and groove strip portions 18 and 20 are interlocked, the complementary faces 81 and 83 are engaged along an interface 85, as shown in FIG. 22. Once the complementary faces 81 and 83 are engaged along the interface 85 a gap area 84 is created between the enlarged portions 80 and 82 shown in FIG. 22. When the slider 22 is positioned at the end stop block 14, the enlarged portions 80 and 82, being larger than the tongue and groove portions to which they are connected, ensure that the slider 22 is tightly secured at the end stop block 14. In a further embodiment, when the slider 22 is tightly secured at the end stop block, the gap 84 can be filled with the center portion 34 of the slider 22 to ensure that a waterproof seal is created, as shown in FIG. 23.

In another embodiment, as shown in FIGS. 23–30, the tongue and groove portions 18 and 20 are fixedly connected at a first end within the end stop block 14. The slider 22 is modified to contain inserts 90 and 92 that directly mate with the tongue and groove strip portions 18 and 20. Such inserts 90 and 92, also referred to herein as mating portions, have been described in detail above. In this embodiment, as the slider 22 is positioned to the end stop 14, the gap area 84 that is created when the tongue and groove strip portions 18 and 20 are mated, is filled with the center portion 34 of the slider 22. In addition, as the slider 22 is positioned at the end stop 14, the gap area 84 that is filled by the center portion 34 is enclosed by the slider 22 to ensure a waterproof connection.

In another aspect of the present invention, the two previous embodiments may be combined. In this embodiment, the slider 22 having the inserts 90 and 92 is combined with the enlarged end portions 80 and 82 having the complementary faces (interface portions) 81 and 83.

Figure 30:
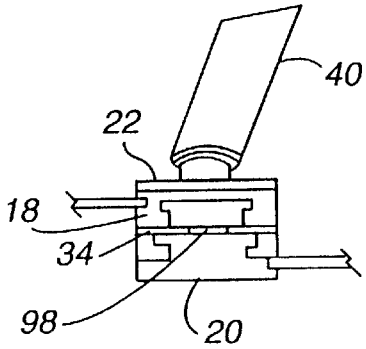
FIG. 30 is a cross-sectional view showing a slider having an opening for receiving a bar of an end stop block.

In yet another embodiment, as shown in FIGS. 27–30, a bar 96, made of a rigid material, may be positioned between the tongue and groove portions 18 and 20 at the end stop block 14. In this embodiment, the bar 96 is connected to the end stop block 14, as are the tongue and groove portions. The bar 96 is formed to fit within the gap area 84, as shown in FIG. 22. When the slider 22 is positioned against the end stop block 14, the bar 96 is positioned within the center portion 34 of the slider 22. In a first aspect of this embodiment, the bar 96 is sized such that the tongue and groove portions 18 and 20 are not compressed and the slider 22 is securely engaged over the tongue and groove portions 18 and 20 without compression. In a second aspect, the bar 96 is sized large enough such that the flexible tongue and groove portions 18 and 20 are compressed against the walls of the slider 22 securely attaching the slider 22 at the end stop block 14. In addition to securely positioning the slider 22, the bar 94 causes a more waterproof seal to be created. As shown in FIG. 30, the slider 22 can contain an opening 98 within the center portion 34 that allows the bar 96 to be positioned through the center portion 34 and within the slider 22. In one embodiment, the opening 98 is expandable to allow a bar 96 having which occupies a larger volume than the opening 98 to be received by the opening 98 with a snug fit. For example, in one embodiment, the center portion 34 having opening 98 is formed of a flexible or expandable material.

Figure 31A:
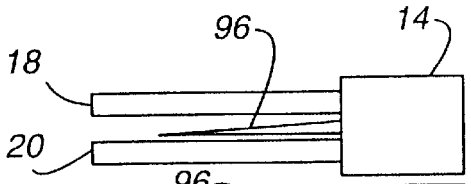
FIG. 31A is a side view showing a flexible bar of an end stop block.
Figure 31B:
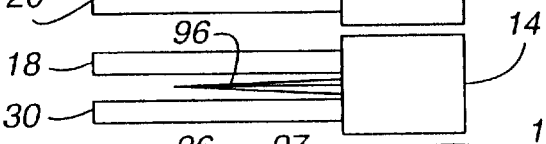
FIG. 31B is a side view showing a flexible bar of an end stop block.
Figure 31C:
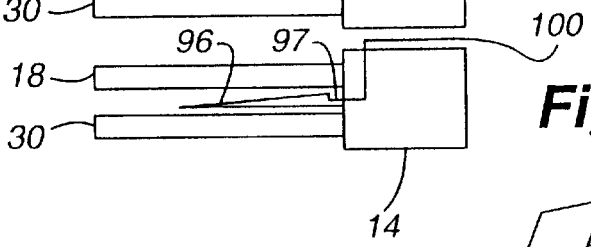
FIG. 31C is a side view of a bar of an end stop block having a positionable button.
Figure 32A:
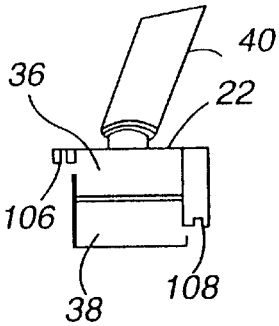
FIG. 32A is a cross-sectional view of a slider modified to contain mating grooves.
Figure 32B:
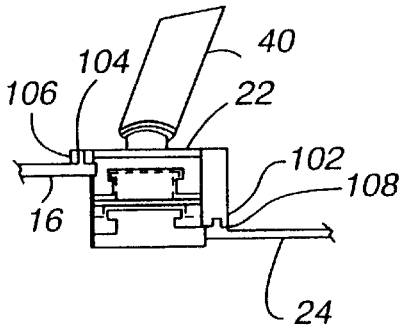
FIG. 32B is a cross-sectional view of a slider modified to contain mating grooves which accept and correspondingly engage ridges of material portion.
Figure 33A:
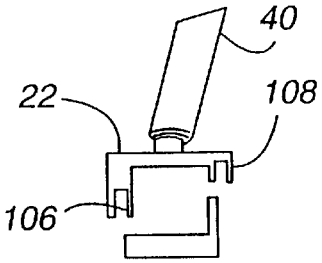
FIG. 33A is a cross-sectional view of a slider modified to contain mating grooves.
Figure 33B:
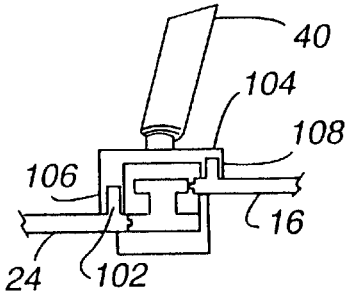
FIG. 33B is a cross-sectional view of a slider modified to contain mating grooves which accept and correspondingly engage ridges of material portion.

Referring to FIGS. 31A–31C, other embodiments of the bar 96 are illustrated. In one embodiment of FIGS. 31A–C, the bar 96 is formed of a flexible material and/or is in a configuration which can be compressed and expanded by pressure on the bar 96. In FIG. 31C, the bar 96 is capable of being deflected by button 100 due to configuration of the bar 96 and a positionable button 100 in a spring-type relationship. More particularly, the bar 96 has a positionable button 100 that allows the conformation of the bar 96 to be compressed when the button 100 is depressed such that the slider 22 to easily be positioned at the end stop block 14. Once the slider 22 is positioned (e.g., within the opening 98 of the center portion 34 of the slider 22), the button 100 may be released to allow the conformation of the bar 96 to expand (i.e., by a spring-type action) and securely engage and hold the slider 22 at the stop block 14. In FIG. 31C, an additional embodiment is shown which includes a shelf portion 97 that may engage a complementary ridge portion (not shown) in the slider 22 such that the slider 22 can be held at the stop block 14.

In other embodiments, as shown in FIGS. 32–35, the tape or fabric portions 16 and 24 (i.e., material portions) which are attached to the tongue and groove strip portions located at the end stop block 14, may contain ridges 102 and 104 perpendicularly positioned with respect to and connected to the tape or fabric portions 16 and 24, and extending a distance from the end stop block 14. The slider 22 is modified to contain mating grooves 106 and 108 which are located in the side walls of the slider 22, extending perpendicular to the slot openings 44 in the slider 22, and which accept and correspondingly engage the ridges 102 and 104 as the slider 22 is positioned at the end stop block 14. As shown in the side view of FIG. 35, the ridge 102 is located a short distance from the end stop block 14, sufficient to allow the mating grooves of the slider to engage the ridges. In FIG. 34, the ridges 102 and 104 extend from the tape or fabric portions 16 and 24. As the slider 22 is positioned at the end stop block 14, the ridges 102 and 104 are positioned within the mating grooves 106 and 108. This embodiment ensures that water is less likely to penetrate the end stop block 14.

Figure 38:
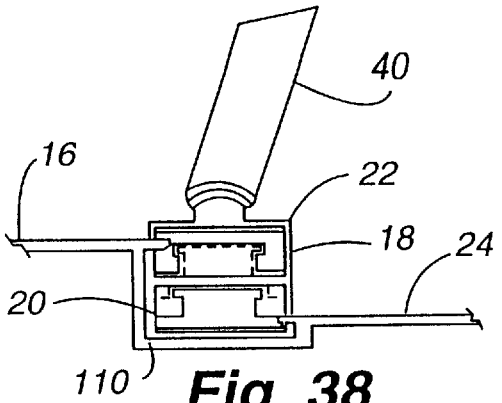
FIG. 38 is a cross-sectional view showing an end stop block having a cover portion.
Figure 39:
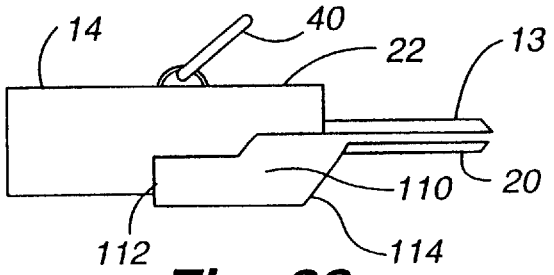
FIG. 39 is a side view of an end stop block showing a cover portion.
Figure 40:
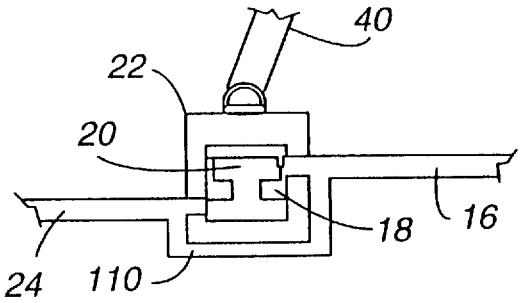
FIG. 40 is a cross-sectional view showing an end stop block having a cover portion.
Figure 41A:
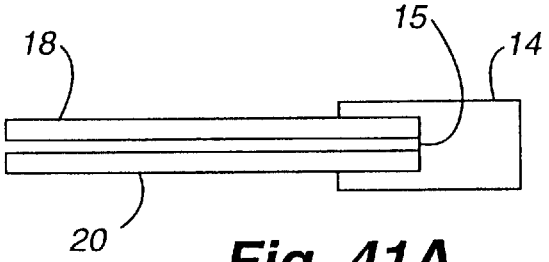
FIG. 41A is a side view showing an end stop block having a shape profile.
Figure 41B:
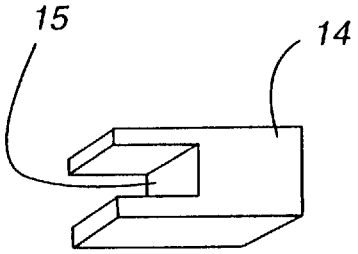
FIG. 41B is a perspective view of a slider having a complementary face to the shape profile of the end stop block of FIG. 41A.
Figure 41C:
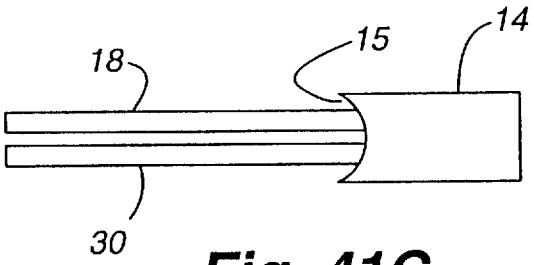
FIG. 41C is a side view showing an end stop block having a shape profile.
Figure 41D:
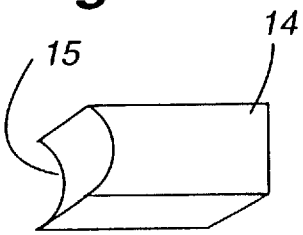
FIG. 41D is a perspective view of a slider having a complementary face to the shape profile of the end stop block of FIG. 41C.

In another embodiment, as shown in FIGS. 37–40, the tape or fabric portion 16 and 24 has a cover portion 110 that closely fits under the bottom exterior wall of the slider 22 when the slider 22 is positioned at the end stop block 14. The cover portion 110 extends a short distance from the end stop block 14 along the longitudinal axis of the strip portions 18 and 20. Referring to FIGS. 38 and 39, the cover portion 110 is interconnected with the tape and fabric portions 16 and 24 and can be connected to the end stop block 14 at the posterior end 112 of the cover portion 110. The anterior end 114 of the cover portion 110 is configured to allow the slider 22 to be positioned within the cover 110 when the slider 22 is at the end stop block 14. The cover may be formed from a waterproof tape or rubber enclosure to ensure that water does not penetrate within the end stop block 14. The cover portion 110 can be coterminous with the slider 22 or extend beyond the slider 22 along the longitudinal axis of the tongue and groove portion 18 and 20 to cover the tongue and groove portion 18 and 20, as shown in FIG. 39.

Figure 45:
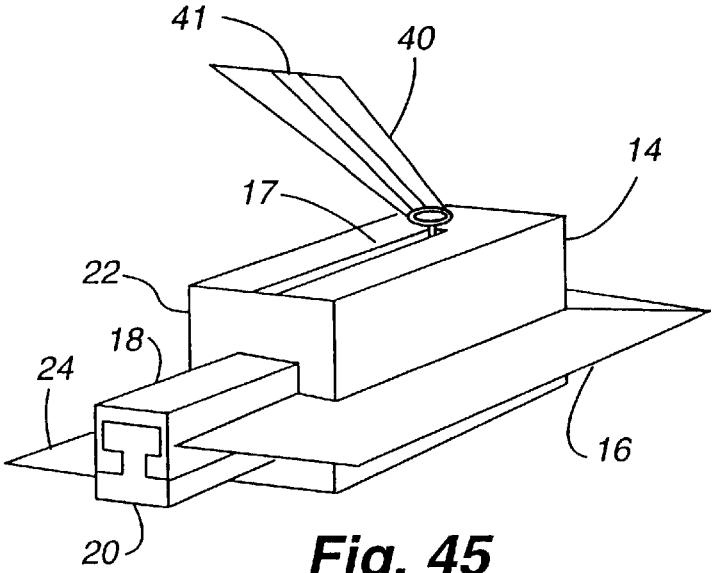
FIG. 45 is a perspective view of a slider positioned within an end stop block with material portions connected directly to the end stop block and further showing a handle and notch configuration.
Figure 46:
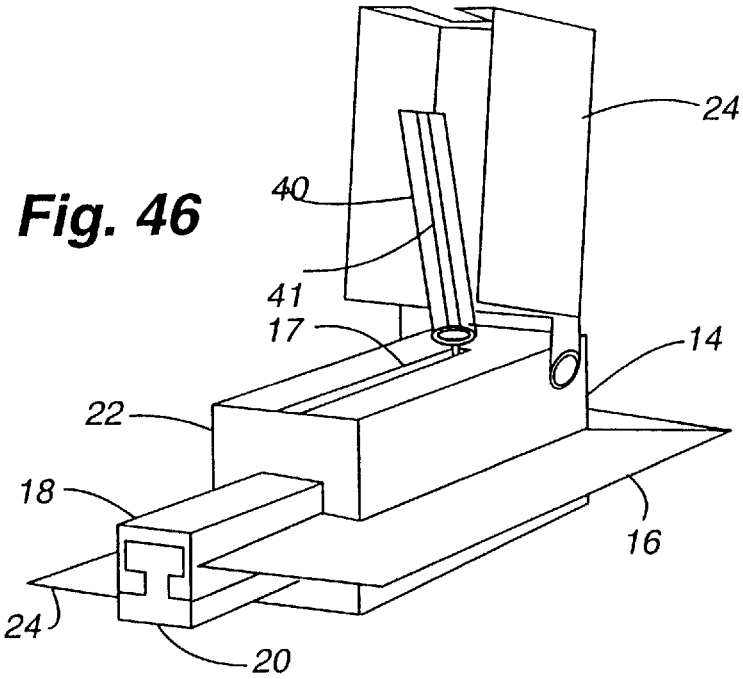
FIG. 46 is a perspective view of an end stop block having a cover.

In yet another embodiment, as shown in FIGS. 43–46, the end stop block 14 is configured to have an interior space for housing the slider 22 when the slider 22 is positioned at the end stop block 14. As shown in FIGS. 43A–B, when the slider 22 is positioned at the end stop block 14, the slider 22 fits securely within the end stop block 14 in the interior space. In FIG. 43B, the cross-section demarked by B—B is shown in FIG. 44. The cross-section indicates that the slider 22 is securely positioned within the end stop block 14. Additionally, a groove 17 is located in the end stop block 14 such that the handle 40 may be positioned in the groove 17 when the slider 22 is positioned within the end stop portion 14. As previously mentioned, the tongue and groove strip portions 18 and 20 may be permanently fixed with the end stop block 14. As shown in FIG. 45 and 46, the tape or fabric portions 16 and 24 are connected around the outside of the end stop block 14. It should be noted that in this embodiment, the end stop block 14 is not split to allow the tape or fabric portions 16 and 24 to pass through the end stop block 14. Instead, the tape or fabric portions 16 and 24, while connected to the tongue and groove portions 18 and 20, are directly connected to the exterior portion of the end stop block 14. As such, the tape or fabric portions that extend into the interior of the end stop block 14 may extend into less than the full length of the end stop block 14 (i.e., the tape or fabric portions 16 and 24 extend half way into the end stop block 14).

In another aspect, as shown in FIGS. 45 and 46, the handle 40 can include a ridge 41 that is capable of being inserted in the groove 17 in the end stop block 14. The ridge 41 allows the handle 40 to be securely engaged against the end stop block 14 to prevent damage to the handle 40 and increase the waterproof nature of the end stop block 14.

In yet another aspect, as shown in FIG. 46, a cover 24 can be connected to the end stop block 14. When the slider 22 is positioned within the end stop block 14 and the ridge 41 of the handle 40 is positioned within the groove 17, the cover 24 is moveable (e.g. by a hinge) and may be closed over the end stop block 14 to enhance the waterproof nature of the end stop block 14. The closing of the cover 24 over the slider 22 and stop block 14 additionally locks the slider 22 into place and conceals the handle 40 from obstacles which may snag or pull the handle 40 and disrupt the seal of the slider 22 and the end stop block 14. In another embodiment, the handle 40 itself, by engaging the notch 17 in the end stop block 14, may serve to lock the slider 22 into place.

The foregoing discussion of the invention has been presented for purposes of illustration and description. Further, the description is not intended to limit the invention to the form disclosed herein. Consequently, variation, modification and combination commensurate with the above teachings, within the skill and knowledge of the relevant art, are within the scope of the present invention. The embodiments described herein and above are further intended to explain the best made presently known of practicing the invention and to enable others skilled in the art to utilize the invention, as such, or in other embodiments, and with the various modifications required by their particular application or uses of the invention. It should be further construed that all of the embodiments disclosed herein may be presented individually or in combination to create inventions that should be deemed within the scope and teaching of the specification presented herein. It is intended that the appended claims be construed to include alternative embodiments to the extent permitted by the prior art.

What is claimed is:

1. A fastening device, comprising:

(a) a groove strip portion having a first end, a second end and an elongated portion having a groove profile, said elongated portion having a groove profile extending longitudinally from said first end to said second end of said groove strip portion;

(b) a tongue strip portion having a first end, a second end and an elongated portion having a tongue profile, said elongated portion having a tongue profile extending longitudinally from said first end to said second end of said tongue strip portion;

wherein said tongue profile is capable of cooperatively interlocking with said groove profile;

wherein said tongue profile comprises a narrow connector piece integral with an enlarged head, and wherein said groove profile comprises a flexible narrow opening integral with a cavity portion, said cavity portion being shaped complimentary to said enlarged head portion and said narrow opening being shaped complimentary to said narrow connector piece such that said cavity portion receives said enlarged head portion and said narrow opening receives said narrow connector piece when said tongue strip portion and said groove strip portion are cooperatively interlocked; and, wherein said cavity portion further comprises a groove insert disposed within said cavity portion for contacting and forming a tight seal with said enlarged head when said tongue strip portion and said groove strip portion are cooperatively interlocked, thereby increasing water resistance of said fastener; and, (c) a slider comprising:

(i) top, bottom and side walls which form a housing having an opening end orifice and a closing end orifice, each of said top, bottom and side walls having an external wall surface and an internal wall surface which forms a channel extending longitudinally through said housing from said opening end orifice to said closing end orifice for passing said groove strip portion and said tongue strip portion therethrough;

wherein said internal wall surface comprises upper and lower flange portions integral with said top and bottom walls, respectively, such that said flange portions of said internal wall surface extend inwardly along said channel; and, (ii) a center portion connected to and extending between said side walls and located intermediate said top wall and said bottom wall at said opening end orifice, said center portion extending longitudinally along less than a total length of said channel from said opening end orifice to said closing end orifice;

wherein said center portion creates upper and lower spaces within said channel at said opening end orifice;

wherein a height distance of said opening end orifice is greater than a height distance of said closing end orifice; arid, wherein said groove strip portion and said tongue strip portion are adapted to pass through said channel from said opening end orifice through said closing end orifice, during which said upper and lower flange portions force said tongue strip portion and said groove strip portion to come into contact, thereby forcing said tongue profile to cooperatively interlock with said groove profile as said strip portions pass through said slider.

2. The device of claim 1, wherein said slider further comprises a handle for moving said slider longitudinally along said tongue and groove strip portions, thereby allowing said tongue and groove portions to move through said channel of said slider.

3. The device of claim 1, wherein said slider comprises:

a first mating portion disposed within said channel for mating with said groove profile; and a second mating portion disposed within said channel for mating with said tongue profile, wherein said first and second mating portions position said tongue and groove profiles to be cooperatively interlocked.

4. The device of claim 3, wherein said first and second mating portions are disposed at an angle relative to one another such that said tongue and groove strip portions mating with said first and second mating portions, respectively, are disposed at an angle relative to one another.

5. The device of claim 1, further comprising:

a first stop block for connecting said first ends of said groove strip portion and said tongue strip portion, wherein said first stop block is separable into two portions to allow said first ends of said groove strip portion and said tongue strip portion to be individually separated at said first stop block; and a second stop block for connecting said second ends of said groove strip portion and said tongue strip portion, wherein said second stop block is separable into two portions to allow said second ends to be individually separated at said second stop block.

6. The device of claim 1, wherein said enlarged head has a conformation comprising a plurality of tongue pieces and said cavity portion has a conformation comprising a plurality of groove portions, said tongue pieces being adapted to be interlocked with said plurality of groove portions when said tongue strip portion and said groove strip portion are cooperatively interlocked, thereby increasing water resistance of said fastener.

7. The device of claim 1, wherein said tongue and groove strip portions further comprise a plurality of metallic inserts disposed within said tongue and groove strip portions to increase the durability and strength of said tongue and groove strip portions.

8. The device of claim 7, wherein said metallic inserts are spaced equidistantly along the longitudinal axis of said tongue and groove strip portions.

9. The device of claim 1, wherein said tongue strip portion further comprises a plurality of teeth fixedly connected to said tongue strip portion and wherein said groove strip portion further comprises a plurality of teeth fixedly connected to said groove strip portion, wherein said teeth on said tongue strip portion are disposed to interlock with said teeth on said groove strip portion when said tongue and groove strip portions are cooperatively interlocked.

10. The device of claim 1, wherein said tongue and groove strip portions cooperatively interlock with one another by frictional engagement.

11. The device of claim 1, further comprising:

a first stop block fixedly connected to said first end of said groove strip portion and said first end of said tongue strip portion; and a second stop block fixedly connected to said second end of said groove strip portion and said second end of said tongue strip portion.

12. The device of claim 11, wherein at least one of said first and second stop blocks comprises a shape profile and said slider comprises a complementary face adapted for cooperatively engaging and interlocking with said shape profile in said at least one of said first and second stop blocks when said slider is at said at least one of said first and second stop blocks.

13. The device of claim 11, wherein at least one of said first and second stop blocks is removably attachable to said groove strip portion and said tongue strip portion.

14. A fastening device, comprising:

(a) a groove strip portion having a first end, a second end and an elongated portion having a groove profile, said elongated portion having a groove profile extending longitudinally from said first end to said second end of said groove strip portion;

(b) a tongue strip portion having a first end, a second end and an elongated portion having a tongue profile, said elongated portion having a tongue profile extending longitudinally from said first end to said second end of said tongue strip portion;

wherein said tongue profile is capable of cooperatively interlocking with said groove profile;

wherein said tongue profile comprises a narrow connector piece integral with an enlarged head, and wherein said groove profile comprises a flexible narrow opening integral with a cavity portion, said cavity portion being shaped complimentary to said enlarged head portion and said narrow opening being shaped complimentary to said narrow connector piece such that said cavity portion receives said enlarged head portion and said narrow opening receives said narrow connector piece when said tongue strip portion and said groove strip portion are cooperatively interlocked; and, wherein said narrow connector piece further comprises a tongue insert disposed at a junction between said narrow connector and said enlarged head, wherein said tongue insert is adapted to be disposed within said cavity portion at said narrow opening when said tongue strip portion and said groove strip portion are cooperatively interlocked, thereby increasing water resistance of said fastener; and, (c) a slider comprising:

(i) top, bottom and side walls which form a housing having an opening end orifice and a closing end orifice, each of said top, bottom and side walls having an external wall surface and an internal wall surface which forms a channel extending longitudinally through said housing from said opening end orifice to said closing end orifice for passing said groove strip portion and said tongue strip portion therethrough;

wherein said internal wall surface comprises upper and lower flange portions integral with said top and bottom walls, respectively, such that said flange portions of said internal wall surface extend inwardly along said channel; and, (ii) a center portion connected to and extending between said side walls and located intermediate said top wall and said bottom wall at said opening end orifice, said center portion extending longitudinally along less than a total length of said channel from said opening end orifice to said closing end orifice;

wherein said center portion creates upper and lower spaces within said channel at said opening end orifice;

wherein a height distance of said opening end orifice is greater than a height distance of said closing end orifice; and, wherein said groove strip portion and said tongue strip portion are adapted to pass through said channel from said opening end orifice through said closing end orifice, during which said upper and lower flange portions force said tongue strip portion and said groove strip portion to come into contact, thereby forcing said tongue profile to cooperatively interlock with said groove profile as said strip portions pass through said slider.

15. The device of claim 14, further comprising:

a first stop block fixedly connected to said first end of said groove strip portion and said first end of said tongue strip portion; and a second stop block fixedly connected to said second end of said groove strip portion and said second end of said tongue strip portion.

16. The device of claim 15, wherein at least one of said first and second stop blocks comprises a shape profile and said slider comprises a complementary face adapted for cooperatively engaging and interlocking with said shape profile in said at least one of said first and second stop blocks when said slider is at said at least one of said first and second stop blocks.

17. A fastening device, comprising:

(a) a groove strip portion having a first end, a second end and an elongated portion having a groove profile, said elongated portion having a groove profile extending longitudinally from said first end to said second end of said groove strip portion;

(b) a tongue strip portion having a first end, a second end and an elongated portion having a tongue profile, said elongated portion having a tongue profile extending longitudinally from said first end to said second end of said tongue strip portion;

wherein said tongue profile is capable of cooperatively interlocking with said groove profile; and, wherein said at least one of said first and second ends of said tongue strip portion comprises a notch;

(c) a slider comprising:

(i) top, bottom and side walls which form a housing having an opening end orifice and a closing end orifice, each of said top, bottom and side walls having an external wall surface and an internal wall surface which forms a channel extending longitudinally through said housing from said opening end orifice to said closing end orifice for passing said groove strip portion and said tongue strip portion therethrough;

wherein said internal wall surface comprises upper and lower flange portions integral with said top and bottom walls, respectively, such that said flange portions of said internal wall surface extend inwardly along said channel; and, (ii) a center portion connected to and extending between said side walls and located intermediate said top wall and said bottom wall at said opening end orifice, said center portion extending longitudinally along less than a total length of said channel from said opening end orifice to said closing end orifice;

wherein said center portion creates upper and lower spaces within said channel at said opening end orifice;

wherein a height distance of said opening end orifice is greater than a height distance of said closing end orifice; and, wherein said groove strip portion and said tongue strip portion are adapted to pass through said channel from said opening end orifice through said closing end orifice, during which said upper and lower flange portions force said tongue strip portion and said groove strip portion to come into contact, thereby forcing said tongue profile to cooperatively interlock with said groove profile as said strip portions pass through said slider; and, (d) a first stop block fixedly secured to said groove strip portion at at least one of said first and second ends;

wherein said at least one of said first and second ends of said tongue strip portion are removably attachable within said first stop block;

wherein said stop block comprises a force generating device comprising:

(i) a button disposed externally to said stop block;

(ii) a spring biasing said button and disposed within said stop block;

(iii) an internal holder disposed within said stop block for contacting said at least one of said first and second ends of said tongue strip portion, said internal holder being connected to and compressible by said spring; and (iv) a tab located within said internal holder and positioned such that said tab engages said notch when said tongue strip portion is within said end stop and when said force generating device is compressed to secure said tongue strip portion within said stop block;

wherein depression of said button releasably compresses said spring and causes said internal holder to apply a force to said tongue strip portion, thereby securing said tongue strip portion within said stop block to secure said tongue and groove strip portions together.

18. The device of claim 17, wherein said first stop block comprises a shape profile and said slider comprises a complementary face adapted for cooperatively engaging and interlocking with said shape profile in said first stop block when said slider is at said first stop block.

19. A fastening device, comprising:

(a) a groove strip portion having a first end, a second end and an elongated portion having a groove profile, said elongated portion having a groove profile extending longitudinally from said first end to said second end of said groove strip portion;

(b) a tongue strip portion having a first end, a second end and an elongated portion having a tongue profile, said elongated portion having a tongue profile extending longitudinally from said first end to said second end of said tongue strip portion;

wherein said tongue profile is capable of cooperatively interlocking with said groove profile;

(c) a slider comprising:

(i) top, bottom and side walls which form a housing having an opening end orifice and a closing end orifice, each of said top, bottom and side walls having an external wall surface and an internal wall surface which forms a channel extending longitudinally through said housing from said opening end orifice to said closing end orifice for passing said groove strip portion and said tongue strip portion therethrough;

wherein said internal wall surface comprises upper and lower flange portions integral with said top and bottom walls, respectively, such that said flange portions of said internal wall surface extend inwardly along said channel; and, (ii) a center portion connected to and extending between said side walls and located intermediate said top wall and said bottom wall at said opening end orifice, said center portion extending longitudinally along less than a total length of said channel from said opening end orifice to said closing end orifice;

wherein said center portion creates upper and lower spaces within said channel at said opening end orifice;

wherein a height distance of said opening end orifice is greater than a height distance of said closing end orifice; and, wherein said groove strip portion and said tongue strip portion are adapted to pass through said channel from said opening end orifice through said closing end orifice, during which said upper and lower flange portions force said tongue strip portion and said groove strip portion to come into contact, thereby forcing said tongue profile to cooperatively interlock with said groove profile as said strip portions pass through said slider; and, (d) a stop block for securing at least one of said first and second ends of said groove strip portion and at least one of said first and second ends of said tongue strip portion, said stop block comprising:

(i) a first enlarged portion having first and second ends, said first end of said first enlarged portion being fixed within said stop block, and said second end of said first enlarged portion being connected to said groove strip portion and having a first interface portion; and, (ii) a second enlarged portion having first and second ends, said first end of said second enlarged portion being fixed within said stop block, and said second end of said second enlarged portion being connected to said tongue strip portion and having a second interface portion;

wherein said first and second interface portions are disposed to become engaged to form an interface when said groove strip portion and said tongue strip portions are interlocked at said stop block, wherein said first and second enlarged portions are larger than said groove and tongue strip portions and are adapted to be received within said channel of said slider to fixedly secure said slider over said first and second enlarged portions.

20. The device of claim 19, wherein said second end of said first enlarged portion is an integral part of said groove strip portion, and wherein said second end of said second enlarged portion is an integral part of said tongue strip portion.

21. The device of claim 19, wherein said first and second enlarged portions of said stop block comprise a shape profile and said slider comprises a complementary face adapted for cooperatively engaging and interlocking with said shape profile in said stop block when said slider is at said stop block.

22. A fastening device, comprising:

(a) a groove strip portion having a first end, a second end and an elongated portion having a groove profile, said elongated portion having a groove profile extending longitudinally from said first end to said second end of said groove strip portion;

(b) a tongue strip portion having a first end, a second end and an elongated portion having a tongue profile, said elongated portion having a tongue profile extending longitudinally from said first end to said second end of said tongue strip portion;

wherein said tongue profile is capable of cooperatively interlocking with said groove profile;

(c) a slider comprising:

(i) top, bottom and side walls which form a housing having an opening end orifice and a closing end orifice, each of said top, bottom and side walls having an external wall surface and an internal wall surface which forms a channel extending longitudinally through said housing from said opening end orifice to said closing end orifice for passing said groove strip portion and said tongue strip portion therethrough;

wherein said internal wall surface comprises upper and lower flange portions integral with said top and bottom walls, respectively, such that said flange portions of said internal wall surface extend inwardly along said channel; and, (ii) a center portion connected to and extending between said side walls and located intermediate said top wall and said bottom wall at said opening end orifice, said center portion extending longitudinally along less than a total length of said channel from said opening end orifice to said closing end orifice;

wherein said center portion creates upper and lower spaces within said channel at said opening end orifice;

wherein a height distance of said opening end orifice is greater than a height distance of said closing end orifice; and, wherein said groove strip portion and said tongue strip portion are adapted to pass through said channel from said opening end orifice through said closing end orifice, during which said upper and lower flange portions force said tongue strip portion and said groove strip portion to come into contact, thereby forcing said tongue profile to cooperatively interlock with said groove profile as said strip portions pass through said slider; and, (d) a stop block fixedly connected to at least one of said first and second ends of said groove strip portion and said tongue strip portion;

said stop block comprising a bar fixedly connected to and extending from said stop block, said bar being located on said stop block between said at least one of said first and second ends of said tongue and groove strip portions, wherein said bar compresses said tongue and groove strip portions against said internal wall surface of said slider when said slider is positioned at said stop block to securely engage said slider at said stop block.

23. The device of claim 22, wherein said stop block comprises a shape profile and said slider comprises a complementary face adapted for cooperatively engaging and interlocking with said shape profile in said stop block when said slider is at said stop block.

24. The device of claim 22, wherein a thickness of said bar is adjustable by a user to allow said slider to be positioned at said stop block and securely engaged.

25. The device of claim 22, wherein said center portion of said slider comprises a longitudinal opening for receiving said bar when said slider is at said stop block.

26. The device of claim 22, wherein said stop block further comprises a force generating device comprising a positionable button disposed in relationship to said bar to apply a compressive force on said bar when said button is depressed such that said slider is freely moveable at said stop block; wherein release of said button allows said bar to compress said tongue and groove strip portions against said internal wall surface of said slider when said slider is positioned at said stop block to securely engage said slider at said stop block.

27. A fastening device, comprising:

(a) a groove strip portion having a first end, a second end and an elongated portion having a groove profile, said elongated portion having a groove profile extending longitudinally from said first end to said second end of said groove strip portion;

(b) a tongue strip portion having a first end, a second end and an elongated portion having a tongue profile, said elongated portion having a tongue profile extending longitudinally from said first end to said second end of said tongue strip portion;

wherein said tongue profile is capable of cooperatively interlocking with said groove profile;

(c) a slider comprising:

(i) top, bottom and side walls which form a housing having an opening end orifice and a closing end orifice, each of said top, bottom and side walls having an external wall surface and an internal wall surface which forms a channel extending longitudinally through said housing from said opening end orifice to said closing end orifice for passing said groove strip portion and said tongue strip portion therethrough;

wherein said internal wall surface comprises upper and lower flange portions integral with said top and bottom walls, respectively, such that said flange portions of said internal wall surface extend inwardly along said channel; and, (ii) a center portion connected to and extending between said side walls and located intermediate said top wall and said bottom wall at said opening end orifice, said center portion extending longitudinally along less than a total length of said channel from said opening end orifice to said closing end orifice;

wherein said center portion creates upper and lower spaces within said channel at said opening end orifice;

wherein a height distance of said opening end orifice is greater than a height distance of said closing end orifice; and, wherein said groove strip portion and said tongue strip portion are adapted to pass through said channel from said opening end orifice through said closing end orifice, during which said upper and lower flange portions force said tongue strip portion and said groove strip portion to come into contact, thereby forcing said tongue profile to cooperatively interlock with said groove profile as said strip portions pass through said slider;

(d) a first material portion connected longitudinally along an outward facing edge of said groove strip portion;

(e) a second material portion connected longitudinally along an outward facing edge of said tongue strip portion;

wherein said first and second material portions are further connected to an article containing said fastener; and, wherein said slider is adapted with a first slot located longitudinally in one side wall and a second slot located longitudinally in another side wall to allow said first and second material portions to pass therethrough as said slider is moved along said tongue strip portion and said groove strip portion; and, (f) a stop block fixedly connected to at least one of said first and second ends of said groove strip portion and said tongue strip portion;

wherein said first material portion comprises a first ridge portion extending perpendicularly from said first material portion, connected to said first material portion, and located a distance from said stop block;

wherein said second material portion comprises a second ridge portion extending perpendicularly from said second material portion, connect to said second material portion, and located a distance from said stop block; and, wherein said slider comprises first and second mating groove portions adapted to receive said first and second ridge portions, each of said first and second mating groove portions being located within one of said side walls of said slider and extending perpendicularly to said first and second slot, respectively;

wherein said first and second mating groove portions correspondingly engage said first and second ridges when said slider is positioned at said stop block.

28. The device of claim 27, wherein said first material portion and said second material portion are located on said outward facing edges of said groove strip portion and said tongue strip portion, respectively, in a non-opposing configuration.

29. The device of claim 27, wherein said stop block comprises a shape profile and said slider comprises a complementary face adapted for cooperatively engaging and interlocking with said shape profile in said stop block when said slider is at said stop block.

30. The device of claim 27, further comprising:

a cover portion interconnected with said first and second material portions and located at said stop block, said cover portion extending perpendicularly from said first material portion, extending over said external wall surface of said bottom wall of said slider, and connecting perpendicularly to said second material portion to encase at least a portion of said slider when said slider is positioned at said end stop.

31. The device of claim 30, wherein said cover portion extends longitudinally from over said stop block to beyond said slider when said slider is positioned at said stop block.

32. A fastening device, comprising:

(a) a groove strip portion having a first end, a second end and an elongated portion having a groove profile, said elongated portion having a groove profile extending longitudinally from said first end to said second end of said groove strip portion;

(b) a tongue strip portion having a first end, a second end and an elongated portion having a tongue profile, said elongated portion having a tongue profile extending longitudinally from said first end to said second end of said tongue strip portion;

wherein said tongue profile is capable of cooperatively interlocking with said groove profile;

(c) a slider comprising:

(i) top, bottom and side walls which form a housing having an opening end orifice and a closing end orifice, each of said top, bottom and side walls having an external wall surface and an internal wall surface which forms a channel extending longitudinally through said housing from said opening end orifice to said closing end orifice for passing said groove strip portion and said tongue strip portion therethrough;

wherein said internal wall surface comprises upper and lower flange portions integral with said top and bottom walls, respectively, such that said flange portions of said internal wall surface extend inwardly along said channel; and, (ii) a center portion connected to and extending between said side walls and located intermediate said top wall and said bottom wall all said opening end orifice, said center portion extending longitudinally along less than a total length of said channel from said opening end orifice to said closing end orifice;

wherein said center portion creates upper and lower spaces within said channel at said opening end orifice;

wherein a height distance of said opening end orifice is greater than a height distance of said closing end orifice; and, wherein said groove strip portion and said tongue strip portion are adapted to pass through said channel from said opening end orifice through said closing end orifice, during which said upper and lower flange portions force said tongue strip portion and said groove strip portion to come into contact, thereby forcing said tongue profile to cooperatively interlock with said groove profile as said strip portions pass through said slider;

(d) a first stop block fixedly connected to said first end of said groove strip portion and said first end of said tongue strip portion; and, (e) a second stop block fixedly connected to said second end of said groove strip portion and said second end of said tongue strip portion;

wherein said second stop block comprises an interior space configured to receive said slider when said slider is at said second stop block.

33. The device of claim 32, wherein said slider further comprises a handle for moving said slider longitudinally along said tongue and groove strip portions, thereby allowing said tongue and groove portions to move through said channel of said slider; and wherein said second store block further comprises a handle groove for receiving said handle when said slider is positioned at said second stop block.

34. The device of claim 33, wherein said handle further comprises a ridge for securely engaging said handle groove.

35. The device of claim 32, wherein said second stop block further comprises a cover which is moveable to enclose said second stop block when said slider is within said second stop block.

36. The device of claim 32, wherein said interior space of said second stop block comprises a shape profile and said slider comprises a complementary face adapted for cooperatively engaging and interlocking with said shape profile in said stop block when said slider is at said stop block.

* * * * *